United States Patent [19]

Carlson et al.

[11] 3,945,322

[45] Mar. 23, 1976

[54] THROUGH-BULKHEAD EXPLOSION INITIATION

[75] Inventors: Bertil V. Carlson, Santa Cruz; Donald C. Zapf, Ben Lomond, both of Calif.

[73] Assignee: The United States of America as represented by the Secretary of the Navy, Washington, D.C.

[22] Filed: Apr. 5, 1974

[21] Appl. No.: 458,252

[52] U.S. Cl. ..... 102/70 R; 102/27 R

[51] Int. Cl.[2] ..... F42B 19/08

[58] Field of Search ..... 102/27 R, 27 F, 70 R

[56] References Cited

UNITED STATES PATENTS

| | | | |
|---|---|---|---|
| 927,968 | 7/1909 | Harle | 102/27 F |
| 3,129,663 | 4/1964 | Schnepfe, Jr. | 102/27 |
| 3,238,873 | 3/1966 | Allen | 102/27 |
| 3,238,876 | 3/1966 | Allen | 102/27 |
| 3,587,466 | 6/1971 | Prior | 102/27 |

*Primary Examiner*—Verlin R. Pendegrass

*Attorney, Agent, or Firm*—R. S. Sciascia; R. F. Beers; P. Schneider

[57] ABSTRACT

A device which transmits an explosion across a bulkhead through a solid hermetic barrier while maintaining the barrier integrally intact and without perforating or rupturing it. The barrier separates a first chamber which receives an output explosive-charge from a second chamber which receives a detonating cord. When the detonating cord is ignited it causes an explosive shock wave to cross the barrier and detonate the output explosive charge. The end of the second chamber has a configuration and dimensions congruent with the output end of the detonating cord so that the explosive shock wave directly crosses the barrier without the need for an explosive charge intermediate the cord and barrier wall.

14 Claims, 5 Drawing Figures

THROUGH-BULKHEAD EXPLOSION INITIATION

BACKGROUND OF THE INVENTION

This invention relates to an apparatus for causing an explosion on one side of a bulkhead by initiating an explosion on the other side of the bulkhead and transmitting the explosive shock wave through the barrier. This is known in the aerospace industry as through-bulkhead initiation (TBI). In TBI technology it is desired to detonate an explosion on one side of a bulkhead and transmit that explosion through to other side of the bulkhead while maintaining the bulkhead structurally intact, that is without being cracked, ruptured or penetrated. Thus while an explosion is transmitted across the bulkhead, no gases, liquids or particles should be permitted to escape from one side to the other. On aerospace vehicles a TBI capability has many uses but finds its primary application in igniting the fuel contained within the fuel chamber of the rocket motor by initiating an explosion on the outside of the chamber.

Previous TBI devices use a variety of means to transmit the energy of an explosion across a bulkhead barrier. One device uses a pair of mating acceptor and donor charges to transmit the explosion. The donor charge on one side of the bulkhead is detonated by an explosive detonating cord and sends an explosive shock wave through the barrier setting off the acceptor charge on the other side. The acceptor charge in turn detonates an output explosive-charge. Two U.S. Pats. of this type are Allen, No. 3,238,876 and Webb, No. 3,209,692. While these devices have been shown to be operative, several problems have arisen in connection with their use. First, high, leak-promoting stress levels are experienced in the bulkhead area when the devices are actuated. Second, a number of small cracks in the barrier, caused by the passage of the explosive shock wave, have been observed. Third, the devices are complex and expensive to fabricate.

DEFINITIONS

For the purposes of accuracy and clarity the following definitions are provided for selected terms which are used in both the specification and claims of this application:

HERMETIC — Made perfectly closed or airtight so that no matter, gas, liquid or solid, can enter or escape.

BARRIER — That solid portion of the bulkhead or TBI device across and through which the explosive shock-wave is transmitted.

SHOCK WAVE — A violent, moving disturbance which advances through a medium by transmission between particles of that medium.

BULKHEAD — An upright partition separating two compartments.

SUMMARY OF THE INVENTION

Briefly, the invention comprises a through-bulkhead initiation device which has a barrier separating a first chamber for the receipt of an output explosive-charge from a second chamber for the receipt of an explosive detonating-cord. The second chamber is so dimensioned and configured as to be congruent with the output end-segment of the explosive detonating-cord, thereby bringing the end-segment of the cord in mating arrangement with one wall of the barrier, as a hand mates with a glove. When the detonating cord is ignited, it generates an explosive shock wave which is directly propagated across the barrier, without the necessity for an intervening booster or donor charge. When the shock wave crosses the barrier it causes the output explosive-charge which fills the chamber across the barrier to detonate. The explosion of the output explosive-charge is used to set off the rocket-fuel primer.

In one embodiment of the invention the output explosive-charge has two separate charges, one an acceptor charge and the other an output ignition-mix, without the need for a donor charge on the other side of the barrier.

In another embodiment of the invention, the acceptor charge is entirely eliminated, and due to a unique chamber configuration and use of a deflagrating output-charge, only the output-charge is detonated by the shock wave crossing the barrier. The further elimination of a component lowers extremely high leak-promoting stress levels experienced in the bulkhead area and minimizes the size and number of cracks in the barrier thereby enhancing the reliability of the device. Such elimination of a component also reduces the cost of the TBI device.

OBJECTS OF THE INVENTION

An object of the invention is to lower the extremely high leak-promoting stress levels experienced in the bulkhead due to the passage of the explosive shock wave across the barrier.

Another object of the invention is to minimize the number and size of cracks in the barrier due to the passage of the explosive shock wave across the barrier.

Another object of the invention is to eliminate the donor charge in a through-bulkhead initiation device thereby enhancing the reliability and reducing the cost of the device.

Other objects, advantages and novel features of the present invention will become apparent from the following detailed description of the invention when considered in conjunction with the accompanying drawings.

BRIEF DESCRIPTION OF THE DRAWINGS

In the drawings the same parts are designated by the same reference numerals while equivalent parts have prime designations.

DETAILED DESCRIPTION OF THE INVENTION

Figure 1:
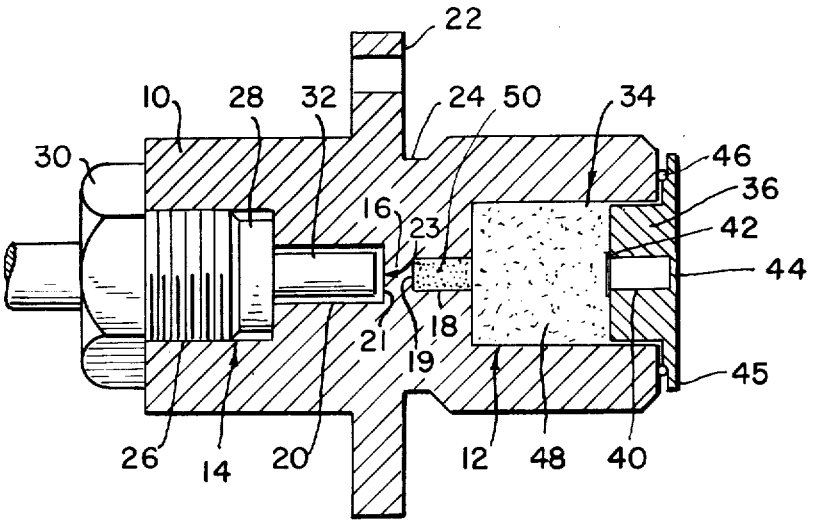
FIG. 1 is an illustration, in cross-section, of one embodiment of the through-bulkhead initiator of the invention.

The through-bulkhead initiator of the invention includes a housing 10, a first chamber 12, a second chamber 14 and a barrier 16. First chamber 12 and second chamber 14 have end portions 18 and 20 respectively which define the first wall 19 and second wall 21 of barrier 16. The housing 10 is fabricated from a metallic structural material, such as a stainless-steel alloy. Some alloys which may be used are 304L ASTM low-carbon stainless-steel or 341 ASTM stainless-steel. The barrier 16 will thus form an integral, hermetic partition between first chamber 12 and second chamber 14. The housing 10 of the TBI is provided with a flange or flanges 22 for attachment to a bulkhead by means of conventional fasteners, such as screws or the like. An annular recess 24 in the housing 10 allows the housing to be sealed hermetically to the bulkhead, thereby preventing the passage of gases, fluids or particles between the two sides of the bulkhead. The first chamber 12 is provided with a mating end-closure 36 to contain output exlosive-charge 34. End closure 36 has recessed propellant-trap 40 capped at one end by metallic foil 42, a frangible, narrowed portion 44, and is sealed to housing 10 by means of a seal 46 and annular land 45. The end portion 18 of first chamber 12 defines the first wall 19 of barrier 16. First chamber 12 may have a variety of configurations and may contain varying compositions of explosive charges, as shown by the two embodiments of FIG. 1 and FIG. 2. The configuration of first chamber 12 and the composition of explosive charge 34 will be described hereinafter in greater detail. Directly across the barrier 16 from the first chamber 12 and coaxial with it lies the second chamber 14. Second chamber 14 is provided with threaded portion 26 and end portion 20 and is configured to accomodate explosive detonating cord 28 which is coupled to housing 10 by nut 30. Detonating cord 28 may be flexible, known as a flexible-confined detonating-cord, or rigid, known as a shielded-mild detonating cord, either of which is commercially available. End portion 20 of second chamber 14 which defines the second wall 21 of barrier 16 has dimensions and a configuration selected to be congruent with and to mate with the dimensions and configuration of end segment 32 of detonating cord 28. Thus, end segment 32 of detonating cord 28 will directly follow the contours and mate with the second wall 21 of the barrier 16, as a hand mates with a glove. The end segment of the cord, however, has a length which is slightly smaller than the length of end portion 20, allowing a slight clearance gap 23, or a proximate relationship between the end face of the cord and the second wall of the barrier. Gap 23 permits the shock wave to travel across it, impinge on the barrier wall 21, be transmitted through barrier 16 to acceptor charge 50 and ignite output explosive-mix 48 while concurrently preventing barrier rupture caused by a backup force or backlash pressure returning across the barrier when the output explosive-charge detonates.

Figure 2:
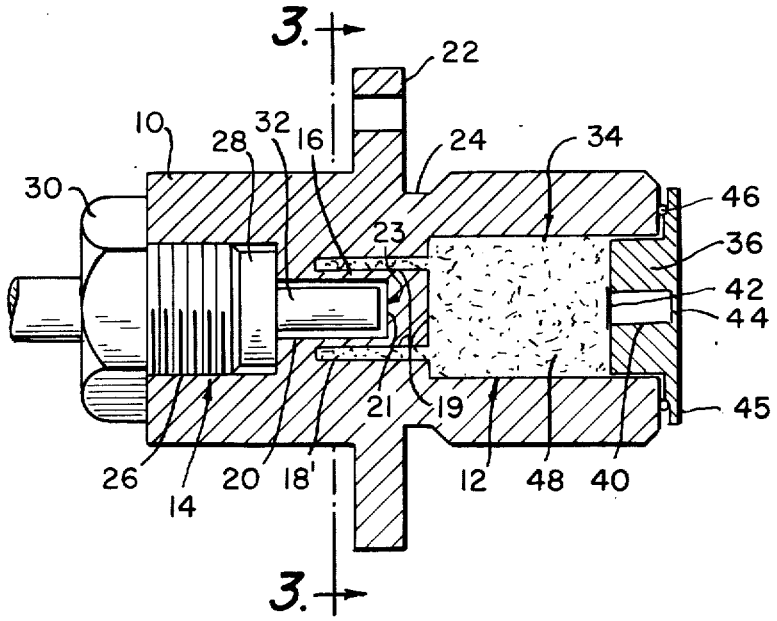
FIG. 2 is an illustration, in cross-section of a second embodiment of the through-bulkhead initiator of the invention.

FIGS. 1 and 2 of the drawings disclose two embodiments of the invention which differ only in the configuration and dimensions of the first chamber and first wall of the barrier, and in the composition of the output explosive-charge.

In FIG. 1, the output explosive-charge 34 has two parts, an output explosive-mix 48 and an acceptor charge 50. The output explosive-mix 48 may be any of a number of handy and well recognized loose-grained explosive materials, and should be insensitive to light shocks due to handling. For example, a mixture of magnesium, potassium perchlorate, cupric oxide and and aluminum may be used without a binder or in a small amount of binder. (It is preferable not to use a binder at all since a binder acts to inhibit the initiation transfer from the explosive input 32 to the deflagrating mixture 48.) The acceptor charge 50 is an explosive such as a crystalline high explosive which is sufficiently sensitive to detonate in response to a shock wave transmitted across the barrier 16. Examples of such explosives are pentaerythritol tetranitrate (PETN), cyclonite (RDX), hexanitro stilbene I, II (HNSI, II) and trinitroglycerine (TNT). Acceptor charge 50 fills the entire end portion of first chamber 12 so that the acceptor charge is directly in contact with the barrier 16, and coaxial with and directly across the barrier from the end portion of chamber 14. The remainder of first chamber 12 is filled with the output explosive mix, as described above.

In the operation of the embodiment of FIG. 1 when it is used to ignite the fuel-primer of a rocket motor, a remote command ignites the leading edge (not shown) of detonating cord 28. The detonating cord transmits the explosion through to the end segment 32 of the cord. The explosion at the tip of end segment 32 inside second chamber 14 produces an explosive shock-wave inside the chamber which travels across gap 23 and impinges on the second wall 21 of the barrier 16. The shock wave of the explosion is propagated longitudinally through barrier 16, without physically rupturing the barrier. When the shock wave crosses the barrier and reaches first wall 19 of the barrier, acceptor charge 50 will detonate in response to the shock wave, and will then detonate output explosive-mix 48. When mix 48 ignites, the pressure of the gaseous reaction products of the explosion ruptures metallic foil 42, forces the products through propellant trap 40, and ruptures the narrow, frangible portion 44 of end closure 36. This pressure carries along the metallic components of mix 48 which have been highly heated by the explosion, but leaves unheated propellant particles behind in propellant trap 40. The pressure then shoots both gaseous reaction products and highly heated metallic components out through the ruptured portion 44 of the end closure, igniting the rocket-motor fuel-primer (not shown).

The thickness of barrier 16 is of great importance in assuring a successful TBI. A compromise between a thick barrier which is less likely to crack or rupture under pressure of the explosive shock wave, and a thin barrier which will insure initiation of the acceptor charge must be made. Tests varying only barrier thickness were performed to obtain statistical data useful in determining optimal barrier thickness. Using this data as a guide, combined with empirical engineering data and safety factors, a barrier thickness of 0.100 of an inch has been established as the optimum, although barrier thicknesses may range from 0.050 to 0.140 of an inch.

Figure 3:
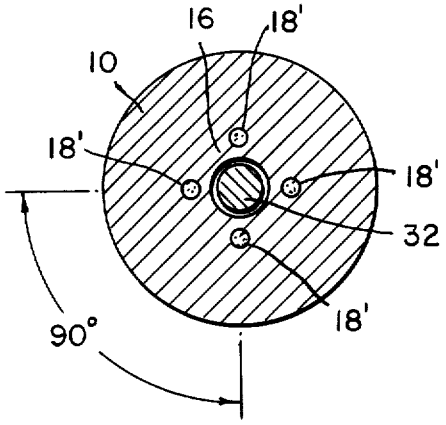
FIG. 3 is a view along sectional line 3—3 of FIG. 2 illustrating the end portion of the chamber containing the output explosive-charge formed by four lower chambers protruding into the barrier.
Figure 4:
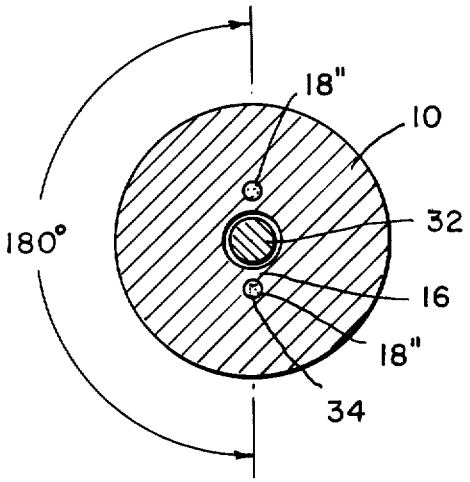
FIG. 4 is a sectional view similar to that of FIG. 3 illustrating a modification of the embodiment of FIG. 2 in which the end portion of the chamber containing the output explosive-charge is formed by two lower chambers protruding into the barrier.
Figure 5:
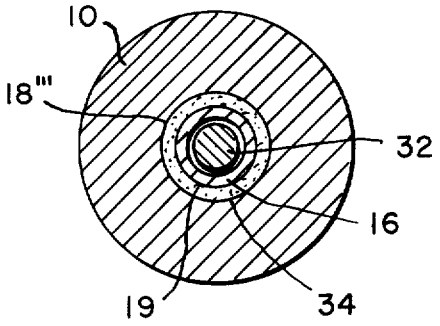
FIG. 5 is also a sectional view similar to that of FIG. 3 illustrating a modification of the embodiment of FIG. 2 in which the end portion of the chamber containing the output explosive is formed by an annular chamber protruding into the barrier.

FIGS. 2 and 3 depict an additional embodiment of the invention which eliminates the acceptor charge 50 of the embodiment of FIG. 1. FIGS. 2 shows a first chamber 12 with output explosive-charge 34 consisting only of uniform output explosive-mix 48 and absent any additional acceptor charge. To detonate without benefit of an acceptor charge, output explosive-mix must be sufficiently sensitive to the explosive shock produced by the detonating cord only. A sensitive deflagrating explosive is therefore required, for example a mixture of magnesium, potassium perchlorate, cupric oxide and aluminum preferably without a binder or in a small amount of binder. Additionally the deflagrating explosive must be placed in relation to the detonating cord so as to efficiently absorb the full effects of the shock wave as it crosses the barrier 16. As seen in FIG. 2 first chamber 12 has an end portion 18$^{1}$ which communicates with chamber 12 and which protrudes into barrier 16 so that end portion 18$^{1}$ overlaps the end portion 20 of second chamber 14 and the end segment 32 of cylindrical detonating-cord 28. Additionally, end portion 18$^{1}$ extends parallel to and along an appreciable portion of the length of end portion 20 and end segment 32. This protruding configuration allows the output explosive-mix 48 in chamber 12 to receive the explosive shock wave transmitted both longitudinally from the flat end face of the detonating cord and radially from the circular peripheral face of the cord. The end portion 18$^{1}$ of first chamber 12 may be formed in a number of ways with a variety of cross-sectional shapes. In the embodiment of FIG. 3, for example, end portion 18$^{1}$ is formed by boring four holes in the housing, all located substantially 90° apart on the periphery of an imaginary circle coaxial with second chamber 14. FIGS. 4 and 5 show two other possible transverse cross-sectional shapes for end portion 18$^{1}$ of chamber 14. In FIG. 4, end portion 18$^{11}$ is formed by boring two holes in the housing, each located on an imaginary circle coaxial with second chamber 14 and space substantially 180° apart. FIG. 5 shows an additional modification in which end portion 18$^{111}$ has an annular transverse cross-section and is coaxial with second chamber 14. In each of these modifications, end portions 18$^{11}$ and 18$^{111}$ protrude into the barrier and extend parallel to and along an appreciable portion of the length of end portion 20 of first chamber 12 and end segment 32 of explosive detonating-cord 28. The operation of the embodiment of FIG. 2 and of the modifications shown in FIG. 4 and FIG. 5 of the TBI is similar to the operation described above for the embodiment of FIG. 1. When detonating-cord 28 is remotely ignited, the explosion is transmitted to end segment 32, causing an explosion in the end portion 20 of chamber 14. The explosion generates a shock wave which travels across gap 23 and then impinges on the second wall 21 of chamber 14 across barrier 16 where it causes detonation of the output explosive-charge 34. The shock wave of the explosion, while traveling longitudinally from the end face of detonating cord 28 through barrier 16, also travels radially from the circular periphery of the side face of end segment 32 of the cord across the barrier to end portions 18$^{1}$ to 18$^{111}$ of first chamber 12. When the shock reaches end portions 18$^{1}$ to 18$^{111}$ it has a crushing effect on these portions of the chamber, igniting the deflagrating output explosive-mix 48 contained therein. The explosion of the output explosive-mix then ruptures foil 42, frangible portion 44 of end closure 38 and ignites the rocket-motor fuel-primer (not shown).

Modifications and variations of the present invention are possible in light of the above teachings. It is therefore to be understood that, within the scope of the appended claims, the invention may be practiced otherwise than as specifically described.

What is claimed is:

1. A through-bulkhead detonation device comprising:

a. a hermetic metallic barrier disposed in the housing of the device, said barrier having a first wall and a second wall, b. a first chamber in the housing for the receipt of an explosive output-charge, located on one side of the barrier, said first chamber being defined on one end by the first wall of the barrier, c. a second chamber in the housing for the receipt of an explosive detonating-cord which has an end segment, said second chamber being coaxial with and located on the opposite side of the barrier from the first chamber, said second chamber being defined on one end by the second wall of the barrier, said end segment having exterior dimensions slightly smaller than and congruent with the interior dimensions of said second chamber so as to enable said end segment to be placed proximate the barrier along the entire length of said end portion and forming a gap between the periphery of said end segment and said second chamber whereby said end segment initiates a shock wave which travels across said gap and across said barrier to detonate this output charge, aid device being distinguished by the absence of a donor charge between said end segment and said barrier.

2. The device of claim 1 in which the explosive output-charge comprises an output explosive mix and an acceptor charge, said acceptor charge being disposed between and in contact with the first wall of the barrier and the explosive output-mix.

3. The device of claim 2 in which the housing is fabricated from stainless-steel.

4. The device of claim 2 in which the explosive detonating-cord is a shielded-mild detonating-cord.

5. The device of claim 2 in which the explosive detonating-cord is a flexible-confined detonating-cord.

6. The device of claim 2 in which the acceptor charge is a crystalline high explosive selected from a group consisting of pentaerythritol tetranitrate, cyclonite, hexanitro stilbene (I), hexanitro stilbene (II) and trinitroglycerine.

7. The device of claim 2 wherein the barrier has a thickness which is the range of 0.050 to 0.140 of an inch.

8. A through-bulkhead detonation device comprising:

a. a hermetic metallic barrier disposed in the housing of the device, said barrier having a first wall and a second wall, b. a first chamber in the housing for the receipt of an explosive output-charge located on one side the barrier, said chamber being defined on one end by the first wall of the barrier, c. a second chamber in the housing for the receipt of an explosive detonating-cord which has a cylindrical end segment with a flat end face and a circular peripheral face, said second chamber being coaxial with and located on the opposite side of the barrier from the first chamber, said second chamber being defined on one end by the second wall of the barrier, said end segment having exterior dimensions slightly smaller than and congruent with the interior dimensions of said second chamber so as to enable said end segment to be placed proximate the barrier along the entire length of said end portion and forming a gap between the periphery of said end segment and said second chamber, whereby said end segment initiates a shock wave which travels across said gap and said barrier to thereby detonate the output charge, said device being distinguished by the absence of a donor charge between said end segment and said barrier, d. an end portion of said first chamber for the receipt of said output explosive-charge, communicating with said first chamber and protruding into the barrier so as to extend parallel with and along an appreciable portion of the length of the end portion of said second chamber and the end segment of said detonating cord, to enable said end segment to initiate a shock wave which travels across said gap and across the barrier longitudinally from the flat end face and radially from the circular peripheral face to thereby detonate the output charge in the first chamber and in the end portion thereof, said device being further distinguished by the absence of an acceptor charge between said barrier and said first chamber.

9. The device of claim 8 in which the housing is fabricated from stainless-steel.

10. The device of claim 8 in which the explosive detonating-cord is a shielded-mild detonating-cord.

11. The device of claim 8 in which the explosive detonating-cord is a flexible-confined detonating-cord.

12. The device of claim 8 in which the end portion of the first chamber comprises four chambers, said chambers having their longitudinal axes parallel with the longitudinal axis of said second chamber.

13. The device of claim 8 in which the end portion of the first chamber comprises of two chambers, said chambers having their longitudinal axes parallel with the longitudinal axis of said second chamber.

14. The device of claim 8 in which the end portion of the first chamber comprises an continuous annular orifice said annular orifice being coaxial with said second chamber.

* * * * *